US005312157A

United States Patent [19]

Logan, Jr.

[11] Patent Number: 5,312,157

[45] Date of Patent: May 17, 1994

[54] LIFT SEAT

[76] Inventor: Emanuel Logan, Jr., 6524 Smokehouse Ct., Columbia, Md. 21045

[21] Appl. No.: 926,430

[22] Filed: Aug. 10, 1992

Related U.S. Application Data

[63] Continuation-in-part of Ser. No. 702,387, Feb. 20, 1991, abandoned.

[51] Int. Cl.[5] ..... A47C 1/08

[52] U.S. Cl. ..... 297/250.1; 297/313; 297/DIG. 10

[58] Field of Search ..... 297/250, DIG. 10, 313; 4/237, 238, 240, 241

[56] References Cited

U.S. PATENT DOCUMENTS

| | | | |
|---|---|---|---|
| 2,849,728 | 9/1958 | Gyllenberg . | |
| 3,473,174 | 10/1969 | Cool | 297/DIG. 10 X |
| 3,479,087 | 11/1969 | Burke . | |
| 3,490,082 | 1/1970 | Murcott . | |
| 3,787,089 | 1/1974 | Wrethander | 297/DIG. 10 X |
| 3,925,833 | 12/1975 | Hunter . | |
| 4,168,552 | 9/1979 | Austin . | |
| 4,185,335 | 1/1980 | Alvis | 297/DIG. 10 X |
| 4,506,930 | 3/1985 | Lambert | 297/DIG. 10 X |
| 4,569,556 | 2/1986 | Pillot . | |
| 4,573,736 | 3/1986 | Levenberg | 297/DIG. 10 X |
| 4,581,778 | 4/1986 | Pontoppidan . | |
| 4,587,678 | 5/1986 | Love et al. | 297/DIG. 10 X |
| 4,637,654 | 1/1987 | Boardman . | |
| 4,777,671 | 10/1988 | Kearns . | |
| 4,833,736 | 5/1989 | Sadler et al. . | |
| 4,884,841 | 12/1989 | Holley | 297/DIG. 10 X |
| 4,907,303 | 3/1990 | Baird . | |
| 4,929,022 | 5/1990 | Geraci | 297/DIG. 10 X |
| 5,063,617 | 11/1991 | Ward et al. | 297/DIG. 10 X |
| 5,631,759 | 12/1986 | Strasser . | |

*Primary Examiner*—Jose V. Chen

*Attorney, Agent, or Firm*—Millen, White, Zelano & ranigan

[57] ABSTRACT

A lift seat includes a seating surface, for example, a toilet seat, mounted on a supporting frame by a four-bar linkage. The four-bar linkage includes a lower link fixed to the frame and an upper link fixed to the seat. An armrest is attached to a front link of the four-bar linkage for pivoting therewith against the bias of the spring which loads the four-bar linkage as the seat is lowered from a raised position to a seating position. Energy stored in the spring is then available to lift the person from the seating position back to the raised position. A damper is connected to the four-bar linkage to prevent abrupt movement of the seat as the four-bar mechanism collapses and expands, while a gas spring is provided to initially resist movement of the four-bar linkage from either the expanded or the collapsed condition unless the armrest is initially rotated.

25 Claims, 10 Drawing Sheets

LIFT SEAT

CROSS-REFERENCE TO RELATED APPLICATIONS

This application is a continuation-in-part of U.S. Pat. Application Ser. No. 07/702,387, filed Feb. 20, 1991, now abandoned in the name of Emanuel Logan, Jr.

BACKGROUND OF THE INVENTION

1. Field of the Invention

The instant invention relates to devices for assisting infirm or injured individuals to move from a standing position to a sitting position and from a sitting position to a standing position. More particularly, the instant invention is directed to improvements chairs and toilet seats which are configured to assist infirm individuals in lowering themselves to and raising themselves from the sitting position.

2. Prior Art

The patent literature includes numerous arrangements for assisting infirm individuals in sitting down and standing up from a chair or toilet seat.

U.S. Pat. No. 4,538,853 discloses a chair with a resilient mechanism for assisting an occupant in raising him- or herself to a standing position. The chair is provided with a seat cushion which pivots relative to the chair frame about an axis near the rearward edge of the frame. The movement also serves to at least simultaneously partially elevate an armrest. When the chair is occupied, resilient struts are compressed to store energy for lifting the occupant. The seat may be manually locked in its lowered position.

U.S. Pat. No. 3,975,051 discloses an orthopedic chair which includes a movably supported frame assembly which serves to maintain a forwardly and downwardly extending saddle-shaped seat at a desired elevation between a pair of laterally spaced sidewalls and a backrest. The chair of this patent utilizes footrests and relies on electricity for its operation.

U.S. Pat. No. 3,473,174 discloses a power-driven, tilted seat in which the seat and associated armrests are fixed relative to one another and move with respect to a supporting frame. Power-actuated hydraulic cylinders are used to raise and lower the seat. U.S. Pat. No. 4,587,678 to Love also relies on an electrically driven hydraulic lift. However, in this patent, the armrests are fixed with respect to the frame, and only the seat moves.

U.S. Pat. No. 4,907,303 discloses an orthopedic chair with a spring-loaded seat, wherein a coil spring is tensioned as a user sits in the seat in order to store energy where it is subsequently used to assist in lifting the user to his or her feet when he or she wishes to stand. A hand brake grips a cable attached to the spring to control application of the spring's force to the seat.

Each of the above-discussed patents are exemplary of prior art approaches to the problem of providing chairs and seats for the infirm. However, none of these seats discloses arrangements wherein a seat not requiring auxiliary power functions effectively for people over a wide range of heights and weights while effectively utilizing ergonomic principles in its design and operation to provide convenience, comfort, and security for its users.

SUMMARY OF THE INVENTION

In view of the aforementioned object, the instant invention contemplates a lift seat for moving a person from an initial raised position to a subsequent lowered position for sitting and thereafter back to the initial raised position to facilitate standing. The lift seat comprises a seating surface upon which the person sits and applies a force; a frame for supporting the seating surface, and a four-bar linkage having a lower link, an upper link, a front link, and a rear link with the front and rear links pivoted to the upper and lower links, the lower link being secured to the frame and the upper link being attached to the seating surface; an armrest for supporting the person using the seat and for initiating operation of the seat. The armrest being secured to one of the links pivoted to the upper and lower links. A spring device is coupled to the four-bar linkage and frame for resisting lowering of the seating surface from the raised to the lowered position and for storing energy provided by the weight of the person sitting on the seat for subsequently lifting the person from the lowered to the raised position.

BRIEF DESCRIPTION OF THE DRAWINGS

Various other objects, features, and attendant advantages of the present invention will be more fully appreciated as the same becomes better understood when considered in conjunction with the accompanying drawings, in which like reference characters designate the same or similar parts throughout the several views and wherein.

DETAILED DESCRIPTION

Figure 1:
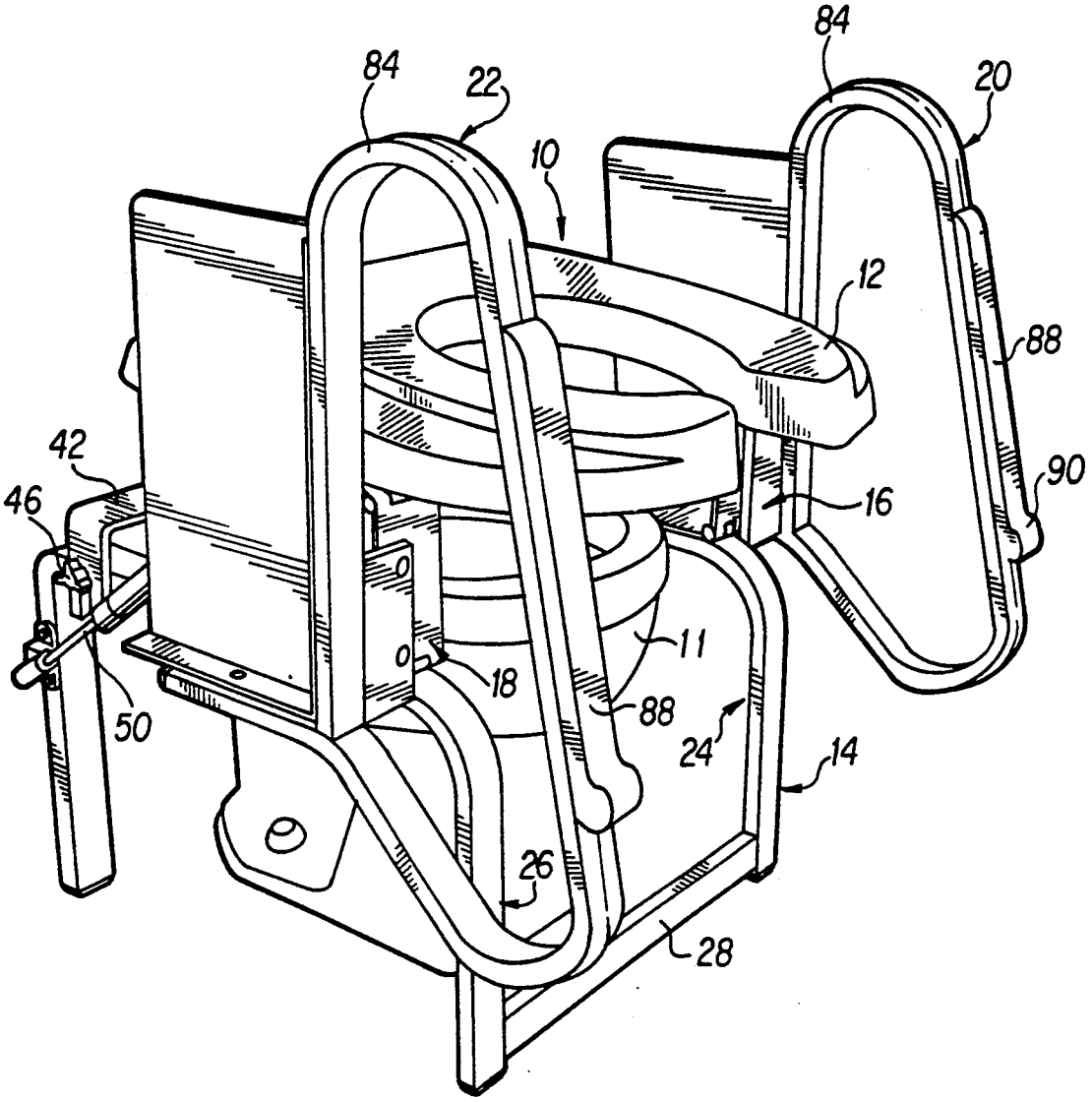
FIG. 1 is a perspective view of a lift seat in the form of a toilet seat configured in accordance with the principles of the instant invention.
Figure 2:
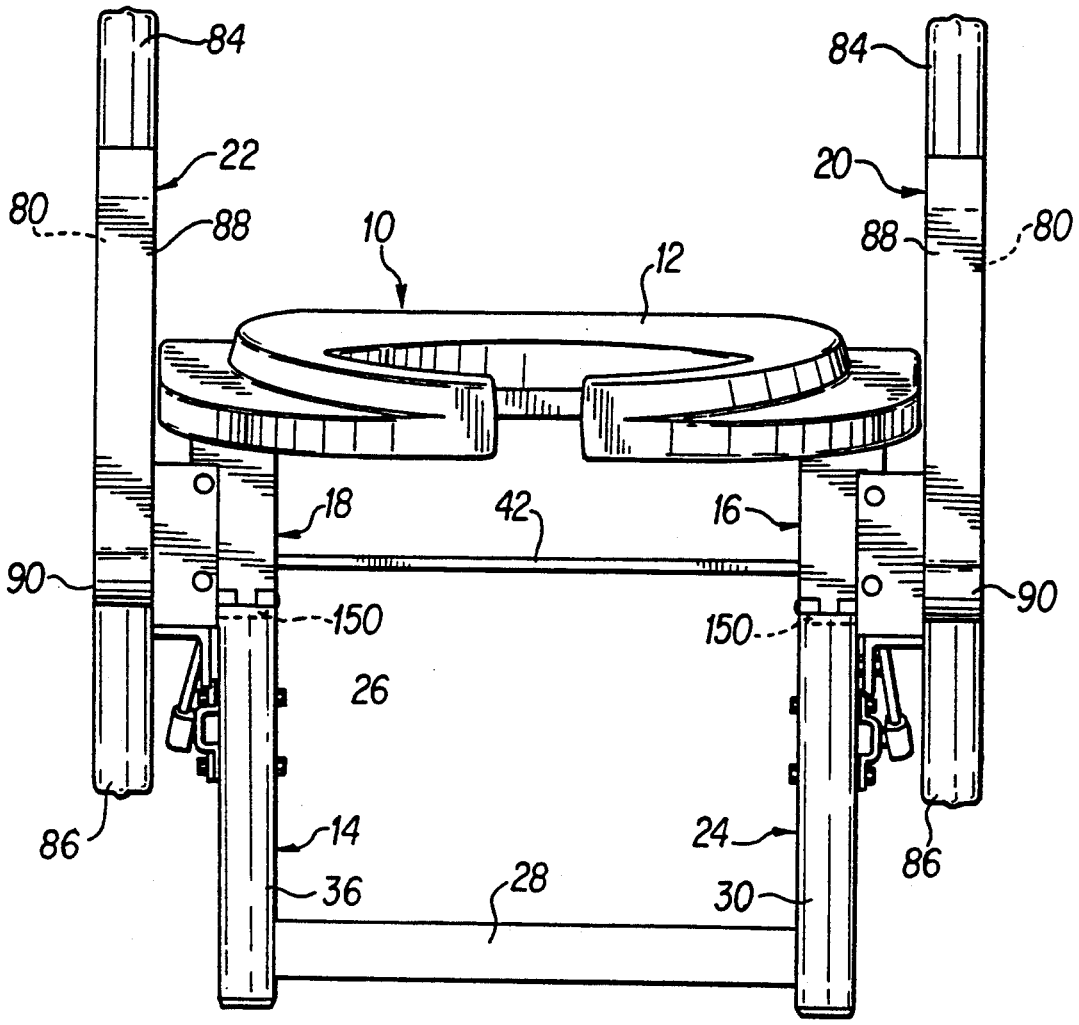
FIG. 2 is a front view of the lift seat of FIG. 1.

Referring now primarily to FIGS. 1-5, there is shown a lift seat, designated by the numeral 10, configured in accordance with the principles of the instant invention. In the illustrated embodiment, the lift seat 10 is positioned over a toilet bowl 11 and includes a toilet seat 12, which is mounted on a frame, designated generally by the numeral 14, by a first and second four-bar linkages, designated generally by the numerals 16 and 18. The four-bar linkages 16 and 18 are joined to one another by a rigid strut 19 so that the four-bar linkages move in concert With one another. A first armrest, designated generally by the numeral 20, is fixed to the first four-bar linkage 16, and a second armrest, designated by the numeral 22, is fixed to the second four-bar linkage 18. The four-bar linkages 16 and 18 are coupled to one another by a rigid strut 19 so as to collapse and expand in concert.

Figure 4:
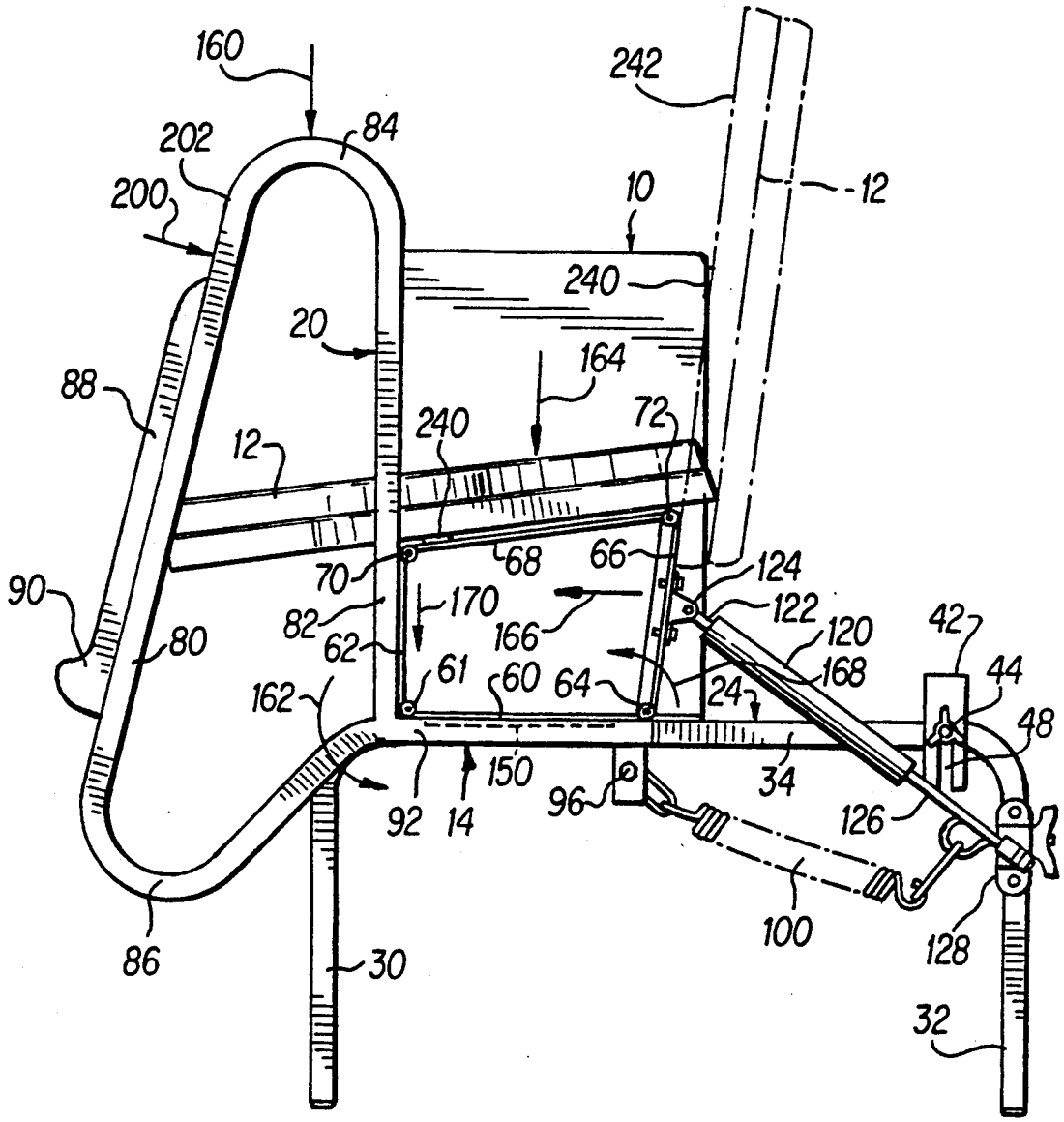
FIG. 4 is a side view of the lift seat of FIG. 1, showing the lift seat in its raised position with the pivoted toilet seat shown in phantom.
Figure 5:
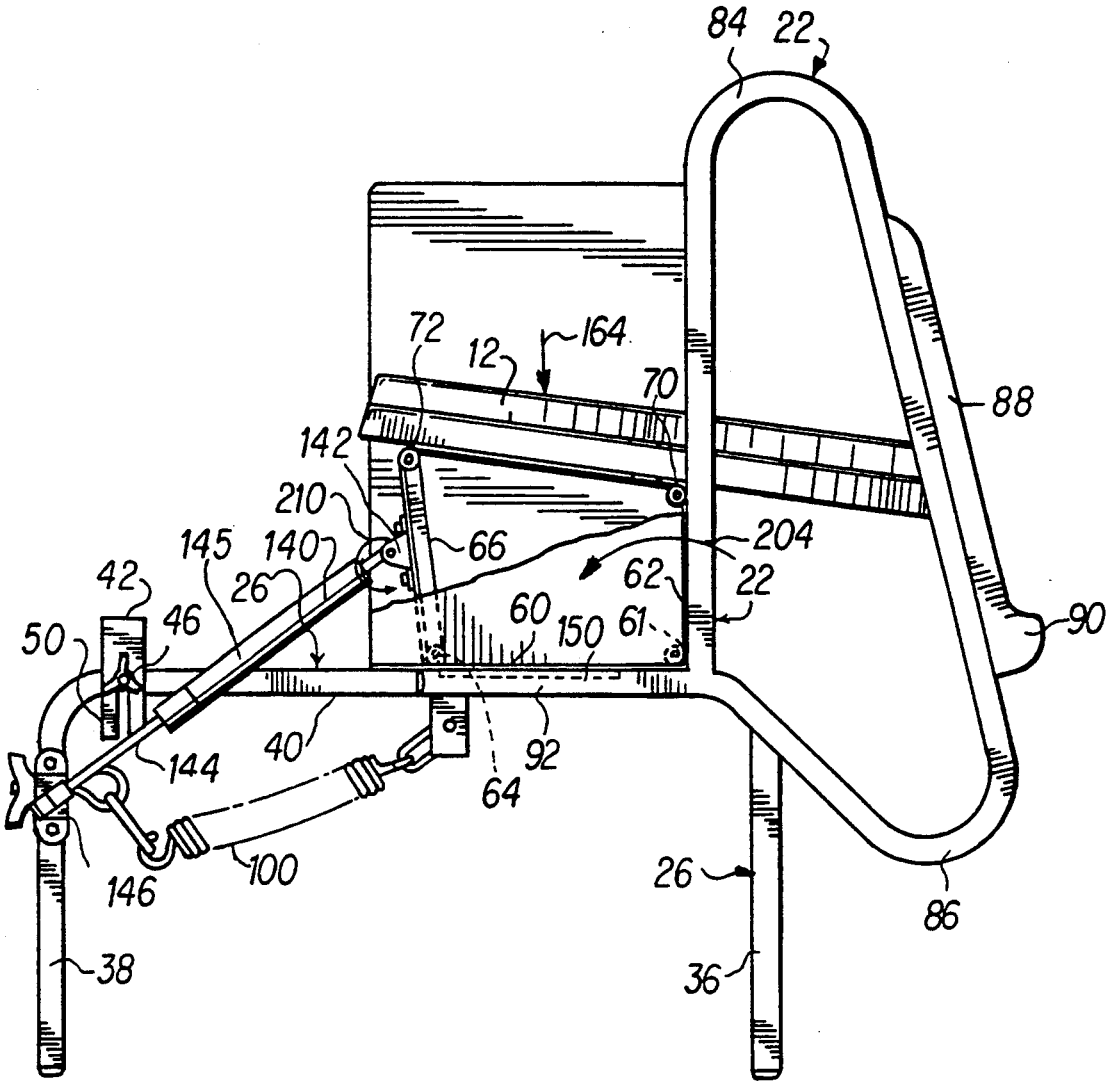
FIG. 5 is a side view of the lift seat viewed from the opposite side from FIG. 4.
Figure 6:
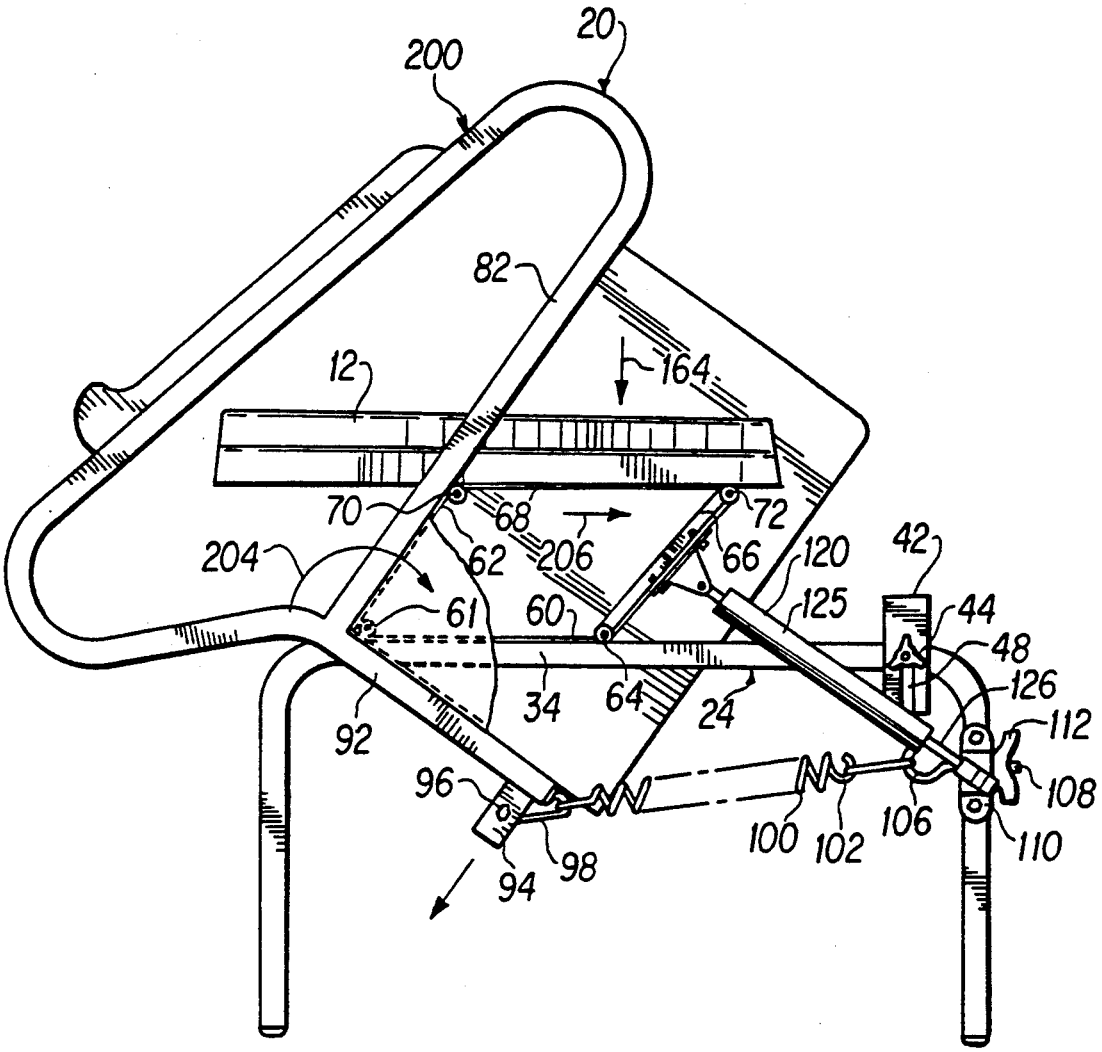
FIG. 6 is a side view taken from the same side as FIG. 4, showing the lift seat collapsing to its lowered position.
Figure 7:
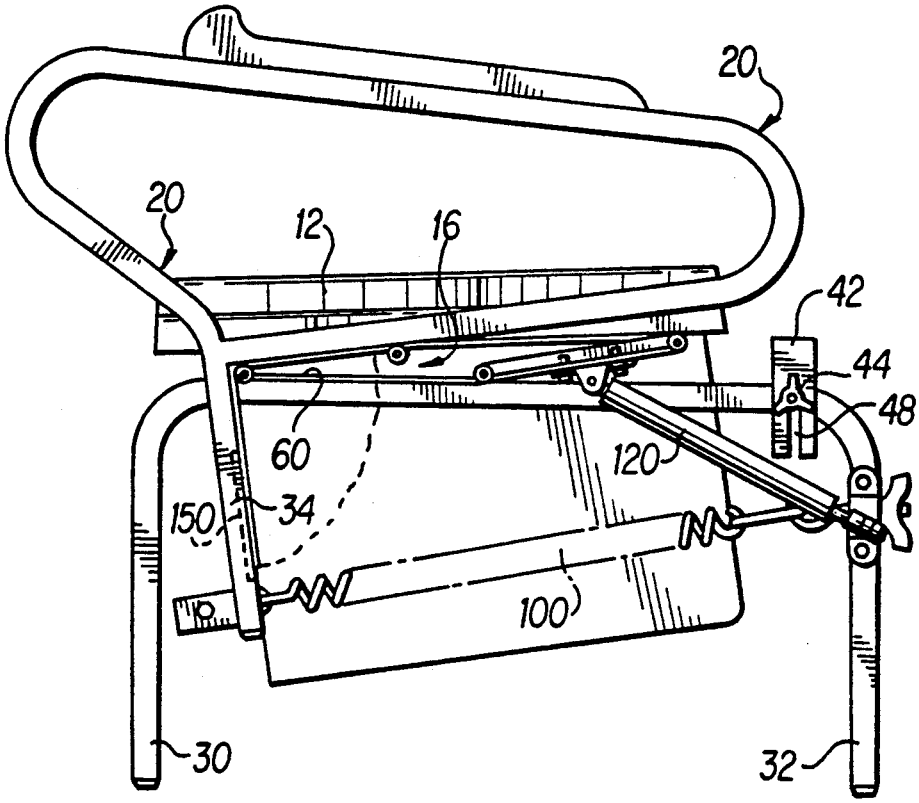
FIG. 7 is a side view taken from the same side and FIGS. 4 and 6, showing the lift seat in its lowered position.

In operation, the toilet seat 12 is lowered from its raised position shown in FIGS. 1-5 through an intermediate mode shown in FIG. 6 to a lowered position shown in FIG. 7. As the toilet seat 12 is lowered from its raised position to its lowered position of FIG. 7, the four-bar linkages 16 and 18 collapse.

The various elements of the lift seat 10 cooperate to provide a safe and convenient device which facilitates lowering an infirm person from a standing to a sitting position. In the illustrated embodiment, the lift seat 10 is utilized with a toilet seat 12, however, the lift seat 10 may be used for any type of chair.

The support frame 14 is rigid and is formed of first and second pairs of U-shaped leg supports 24 and 26 connected by a front brace 28. The first leg support 24 is shown in the side view of FIG. 4 and comprises a front leg 30 and a rear leg 32 joined by a beam 34. The second leg support 26 is shown in the side view of FIG. 5 and comprises a front leg 36, joined to a rear leg 38 by a beam 40. The strut 28 joins only the front legs 30 and 36 proximate the floor upon which the support frame 14 rests so that the toilet bowl 11 may be received between the rear legs 32 and 38. A U-shaped connecting bar 42 is connected to the first and second beams 34 and 40 of the U-shaped leg supports 16 and 18 by thread bolts 44 and 46, which are received in slots 48 and 50 in the ends of the U-shaped bar 42. The U-shaped bar 42 includes a pair of slots 52 and 56, which receive the bolts which normally retain the toilet seat (not shown) ordinarily associated with the toilet bowl 11.

Figure 3:
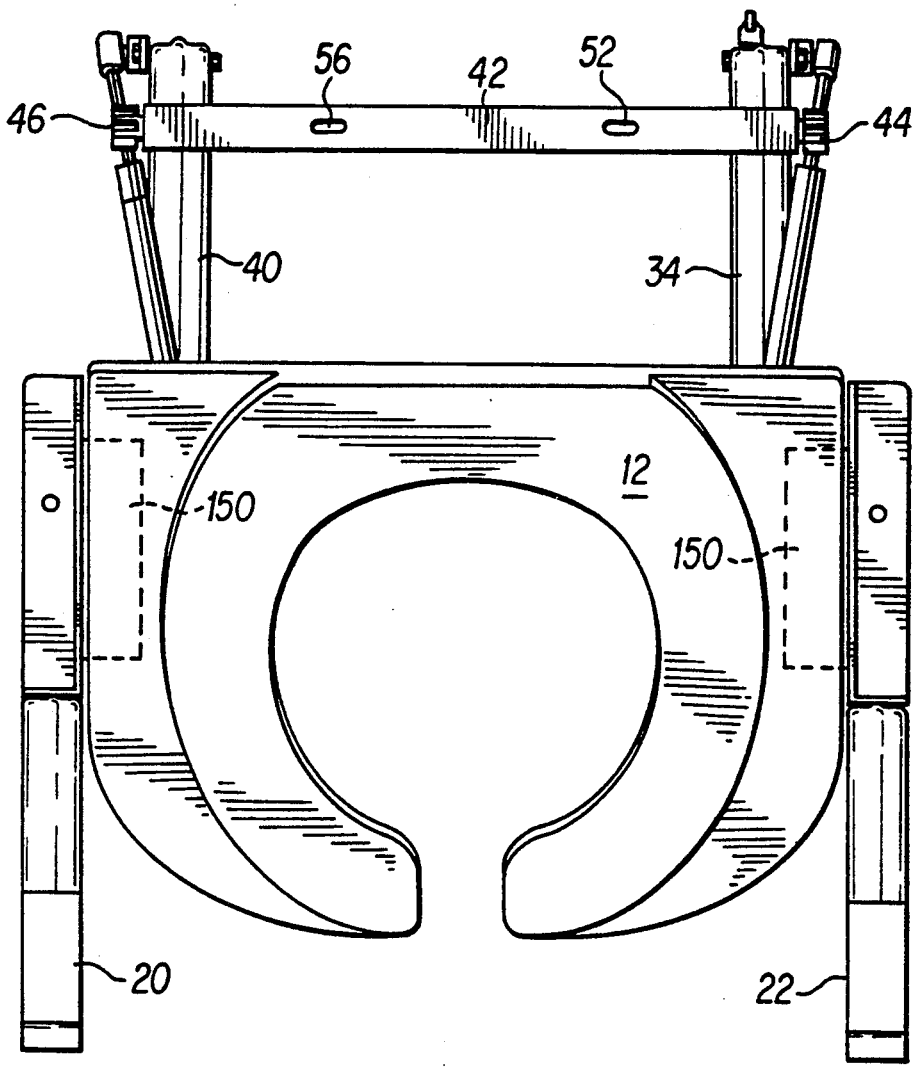
FIG. 3 is a top view of the lift seat of FIG. 2.

Referring now mainly to the side view of FIGS. 4-10, the four-bar linkages 16 and 18 disposed between the toilet seat 12 and the frame 14 each include base links 60, which are fixed to the bars 34 and 40 of the U-shaped leg supports 24 and 26. Pivoted by pivots 61 to the front ends of the base links 60 are front links 62, which are fixed to the armrests 20 and 22. Pivoted to the rear end of the base links 60 by pivots 64 are rear links 66, which cooperate with the front links 62 to determine the height and attitude of the toilet seat 12. The front links 62 are pivoted to top links 68 by hinges 70, while the rear links 66 are pivoted to the top links 68 by hinges 72. The toilet seat 12 is fixed to the top links 68, but, as seen in FIG. 3, the toilet seat pivots to the phantom position with respect to the top links 68. The armrests 20 and 22, which are bolted or otherwise fixed to the front links 62 of the four-bar linkages 16 and 18, each includes an upper rail 80 and a lower rail 82, which is joined to the upper rail by U-shaped portions 84 and 86. Fixed to the top rails 80 are grips 88, each having a raised hand-stop portion 90. When the seat is in its lowered position, as shown in FIG. 7, the grips 88 are horizontal. Depending from the lower rail 82 and rigid with respect to the armrest structures are struts 92, each of which has a lug 94 thereon, with a eyelet 96 retaining a loop 98 for connecting a coil spring 100 thereto. In the preferred embodiment, a coil spring 100 is attached only to the strut 92 of armrest 20. A second end 102 of the spring 100 is attached to a loop 104 which, in turn, is secured to a hook 106. The hook 106 has a threaded shank 108 which passes through the rear leg 32 of the U-shaped leg support 24. A nut 112 on the shank 108 is used to adjust the tension on coil spring 100. As is seen in FIGS. 4 and 5, the coil spring 100 is untensioned when the toilet seat 12 is in its raised position. It only becomes tensioned after a person sits on the seat 12 and seat lowers, as is seen in FIG. 6.

While in the raised position of FIG. 4, the seat 12 is held biased to its fully raised position by a gas spring 120, which has a projecting rod 122 pivoted to a bracket 124 fixed on the rear link 66 and a piston rod 126 pivoted on a bracket 128 mounted on the rear leg 32 of the U-shaped support leg 24. In the preferred embodiment of the invention, only a single gas spring 120 is used in conjunction with the coil spring 100.

Secured to the other rear link 66 (FIG. 5) is a damper 140, the cylinder of which is pivoted to a bracket 142 affixed to the rear link 66 and a piston rod 144 of which is pivoted to a bracket 146 fixed on the rear leg 38 of the U-shaped leg support 26.

The gas spring 120 holds the four-bar linkages 16 and 18 in the expanded position of FIGS. 1-4 by causing flanges (dotted lines 150), which are fixed to struts 92, to engage bottom surfaces of the base links 60. In this way, the four-bar linkages 16 and 18 are normally prevented from collapsing in the forward or rearward direction against the bias of the gas spring 120, the coil spring 100, and the damping strut 140.

In operation, when the user approaches the lift seat 10, the user may support him- or herself by grasping the U-shaped connecting portions 84 of the armrests 20 and 22 while facing the lift seat. When in this position, the user applies force to the armrests in the direction of arrow 160. This induces torque in the armrests 20 and 22 in the direction of arrow 162 about pivot point 61. The torque in the direction of arrow 162 causes the flanges 150 extending inwardly from the strut 92 to abut the base link 60, providing a rigid, stable support for the person facing the lift seat 10.

When the person turns around and faces away from the lift seat 10, the person can still support himself on the U-shaped connecting position 80. When one sits on the seat 12 while the seat is in the raised position of FIGS. 1-5, the seat does not initially sink toward its lowered position of FIG. 7 but, rather, remains in the raised position. This is because the four-bar linkages 16 and 18 are prevented from collapsing due to the gas spring 120 and the damping strut 140 holding the rear links 66 in the expanded position in which the vertical component induced in the four-bar linkages 16 and 18 by a person's weight applied in the direction of arrow 164 tends to pull the rear link 66 forward in the direction of arrow 166. In other words, the force 164 of the person's weight tends to rotate the rear link 66 about the pivot 64 in the counterclockwise direction in FIG. 3, exemplified by the arrow 168. These forces are applied through the top link 68 and downwardly in the direction of the arrow 170 in the front link 62, which links 62 are fixed to the bottom rail 82 of the armrests 20 and 22. The armrests 20 and 22 tend to rotate in the direction of arrow 162 and press the stop plate 150 against the bottom of base link 60 as long as force is applied with a resultant component in the direction of arrow 60. This is, however, a fine balance, which, as will be explained hereinafter, is easily overcome by the person sitting on the toilet seat 12 or by a helper.

In order to lower the seat 12 with a person sitting thereon, the person overcomes the static relationship established by the four-bar linkages 16 and 18 by applying a slight force in the direction of arrow 200 (see FIG. 4). This is accomplished by simply moving one's hand forward on the U-shaped connecting portion 84, applying a very slight pressure at an area 202 on the rail 80.

As is best seen in FIG. 6, this slight pressure causes the armrests 18 and 20 to pivot in the direction of arrow 204 about pivot point 61. Since the bottom rails 82 are fixed to the front link 62 of the four-bar linkages 16 and 18, a force in the direction of arrow 206 is applied through the upper links 68. This force 206 tends to shift the force component 164 (see also FIG. 4) provided by the user's weight slightly over center with respect to the gas spring 120 so that instead of the gas spring 120 being pulled to extend (which the gas spring cannot do), the gas spring is moved slightly over center so that it is positioned by the rear link 66 to collapse under the force 164 of the person's weight. When the gas spring 120 is positioned to collapse, the piston rod 126 slides into the cylinder, compressing gas in the cylinder 125 and storing that energy in the gas spring for subsequent use.

The damper 140 (see FIG. 5) is positioned on the opposite side of the chair, as shown in FIGS. 4 and 6, and initially operates in substantially the same fashion as the gas spring 120. In other words, the damper 140 initially holds the rear link 66 in a position such that the weight component 164 of the person sitting on the toilet seat 12 pulls the damper in extension. Again, when the armrest 22 is rotated in the direction of arrow 204 (also see FIG. 6) about the pivot 61, the damper 140 is rotated slightly in the direction of arrow 210 so as to go over center and allow the weight of the person on the seat 12 to collapse the damper so that the piston on the end of piston rod 144 slides into the cylinder 145.

As is seen in FIGS. 4 and 5, the coil spring 100 is initially slack. However, as the four-bar linkages 16 and 18 begin to collapse, the coil spring 100 is tensioned, as is seen in FIG. 6. The coil spring 100 thereafter resists rotation of the armrests 20 and 22 in the direction of the arrow 204 and stores the energy imparted by force component 164 due to the weight of the person sitting on the seat 12. When the seat 12 reaches its completely collapsed position, as shown in FIG. 7, the spring 100 has stored a substantial portion of the energy imparted by the person sitting on the seat 12. This partial energy is available to help lift the person back to the standing position. While the coil spring 100 is completely tensioned in FIG. 7, the gas spring 120 is again over center, only this time, it is exerting a force tending to keep the four-bar linkages 16 and 18 collapsed. This provides a slight force which must be overcome in order to feed the energy of the spring 100 back into the system to start rotation of the armrest 120 in the direction 220, as shown in FIG. 8.

Figure 8:
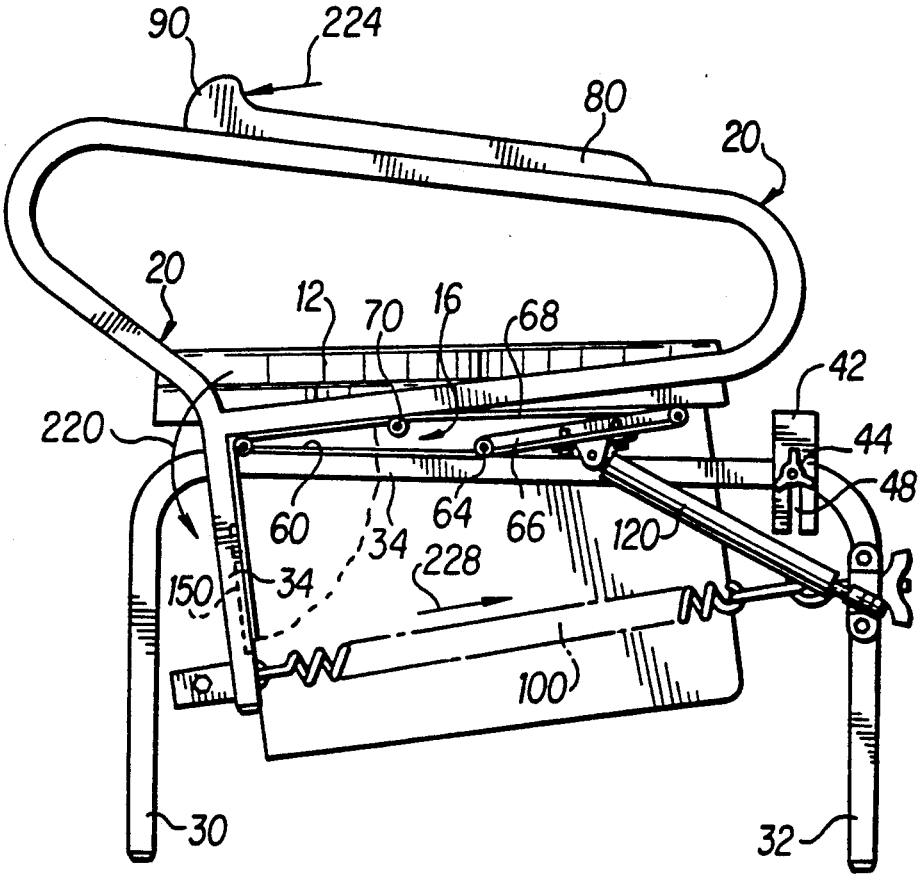
FIG. 8 is a side view similar to FIG. 7 showing initial forces necessary to raise the seat.
Figure 9:
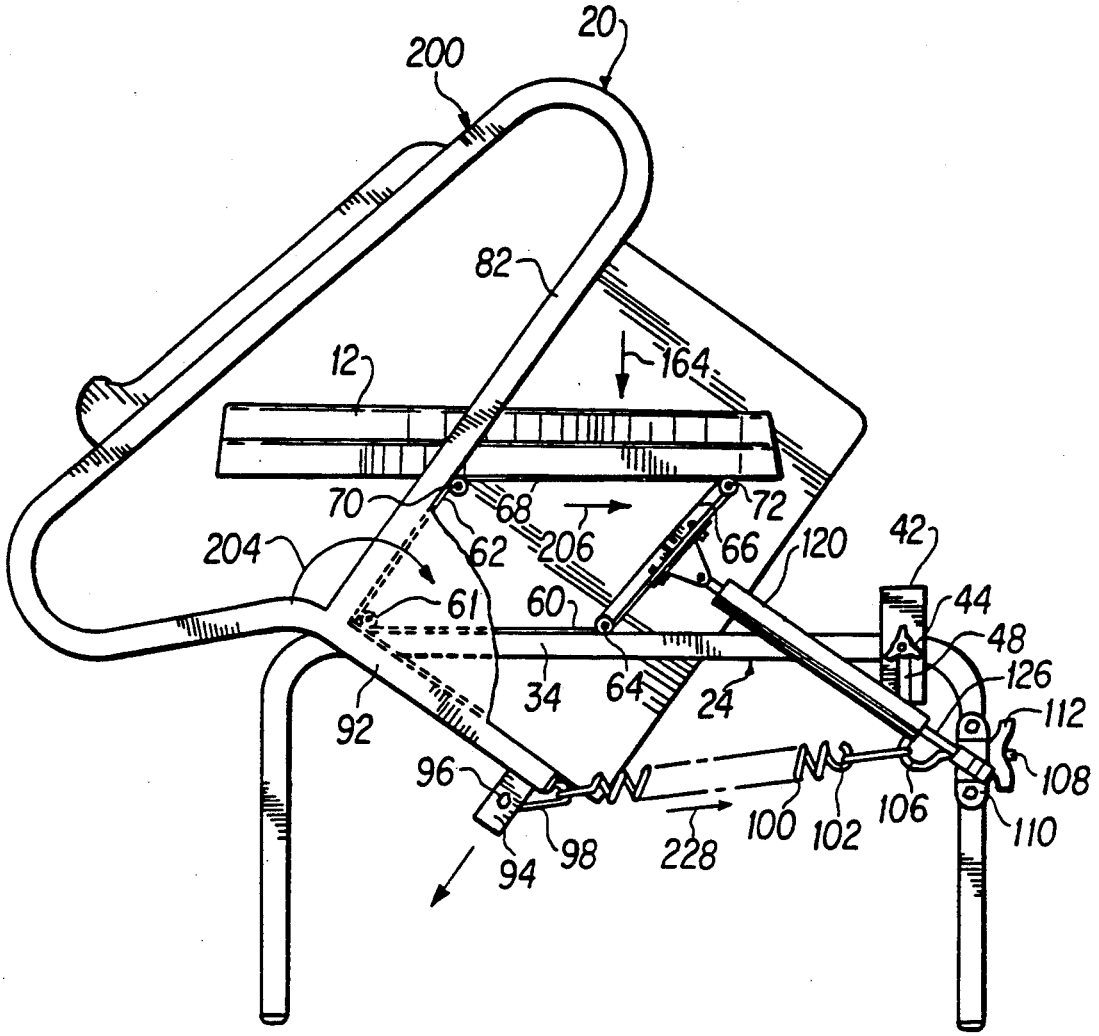
FIG. 9 is a side view showing the seat rising to lift its occupant to a raised position which facilitates standing.
Figure 10:
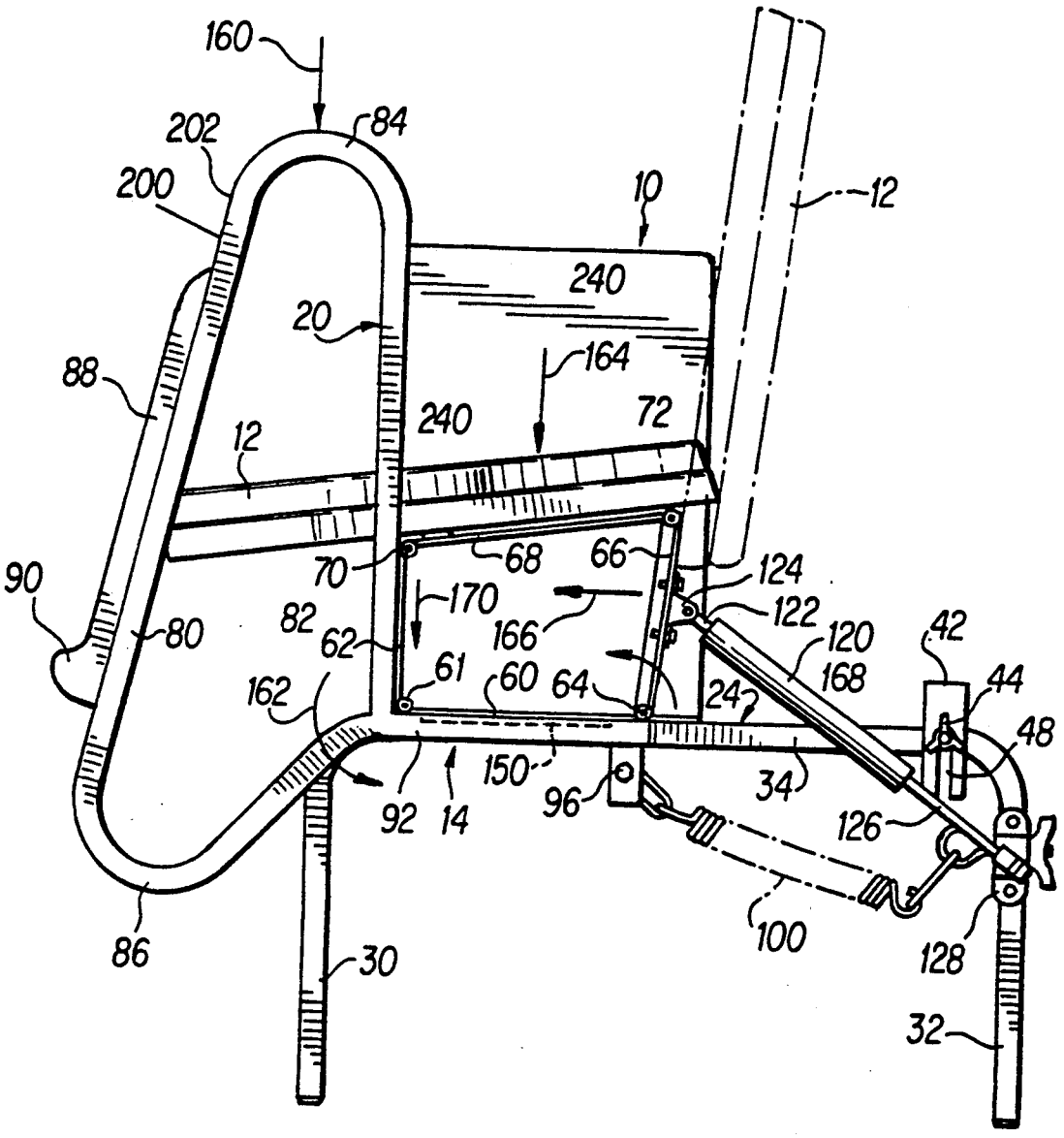
FIG. 10 is a side view showing the seat in its raised position.

Referring now more particularly to FIGS. 8, 9, and 10, when the person wishes to stand up, a slight for 224 is applied against the projections 90 on the grips 88 to start the armrests 20 and 22 rotating in the direction of arrow 220. This initially slightly lifts the front link 62 which, in turn, pulls the top link 68 via the connection provided by the hinge 70. The tension in top link 68 causes the rear link 66 to begin rotating about the hinge 64 which, in turn, lifts the upper end of gas spring 120 over center so that the gas spring 120 now applies its force to expand the four-bar linkage 16 rather than to collapse the four-bar linkage 16. The coil spring 100 is already applying a force in the direction of arrow 228, which force is added to that of the gas spring 120. The user then leans slightly forward to shift his or her weight slightly forward, and the energy stored in coil spring 100 and gas spring 120 lifts the seat 12 with the person sitting thereon smoothly through the intermediate position of FIG. 9 to the final position of FIG. 10, a position from which the person can easily stand.

In order to prevent the springs 100 and 120 from applying their force too rapidly, the damper 140 (see FIG. 5) resists rapid movement of the rear links 66 from the FIG. 8 position through the FIG. 9 position to the FIG. 10 position.

As is seen in FIG. 4, the toilet seat 12 has a pair of pads 240 on the bottom surface 242 thereof. The pads 240 abut the top surface of the top link 68 in the four-bar linkages 16 and 18. The attitude or angular orientation of the seat 12 with respect to the horizontal can, therefore, be controlled to lift the seat slightly so as to accommodate taller individuals or so as to lower the seat. Since the seat 12 is pivoted on the upper links 68, adjustment of its height by determining the angle that it forms with the upper links is easily accomplished by lifting the seat up and changing the thickness of the pads 240.

By the interaction and cooperation of the gas spring 120, the coil spring 100, and the damper 140 with the four-bar linkages 16 and 18 joined by the strut 19, the toilet seat 12 moves between its raised and lowered position with a smooth, unabrupt motion. The armrests 20 and 22 allow the person using the seat to initially brace him- or herself and then to initiate lowering and raising of the toilet seat 12 by exerting minimal effort. A lift seat is, therefore, provided which assists infirm individuals in both standing and sitting.

Without further elaboration, it is believed that one skilled in the art can, using the preceding description, utilize the present invention to its fullest extent. The following preferred specific embodiments are, therefore, to be construed as merely illustrative and not limitative of the remainder of the disclosure in any way whatsoever.

From the foregoing description, one skilled in the art can easily ascertain the essential characteristics of this invention and, without departing from the spirit and scope thereof, can make various changes and modifications of the invention to adapt it to various usages and conditions.

The entire disclosure of all applications, patents, and publications, cited herein are hereby incorporated by reference.

I claim:

1. A lift seat for moving a person from an initial raised position to a subsequent lowered position for sitting and thereafter back to the initial raised position to facilitate standing, the lift seat comprising:

a frame;

a seating surface upon which the person sits and applies a force due to the weight of the person;

a four-bar linkage for supporting the seating surface on the frame, the four-bar linkage having a lower link, an upper link, a front link, and a rear link, with the front and rear links pivoted to the upper and lower links, the lower link being secured to the frame and the upper link being attached to the seating surface; the four bar linkage being shiftable between expanded and collapsed condition corresponding to the raised and lowered positions, respectively of the seat;

armrest means for supporting the individual using the seat, movement of the armrest means initiating operation of the seat, the armrest means being secured to one of the links pivoted to the upper and lower links; and spring means coupled to the four-bar linkage and frame for resisting lowering of the seating surface from the raised to the lowered position and for storing energy provided by the weight of the person sitting on the seat for subsequently lifting the person from the lowered to the raised position.

2. The lift seat of claim 1, further including damper means coupled to the four-bar linkage for resisting movement of the four-bar linkage from the expanded to the collapsed position and from the collapsed position to the expanded position.

3. The lift seat of claim 2, further including stop means disposed between the armrest means and frame, the stop means engaging when the seat is in the raised position for preventing the four-bar linkage from collapsing in a first direction and for allowing the four-bar linkage to collapse in a second direction opposite the first direction.

4. The lift seat of claim 3, wherein the seating surface is a toilet seat and wherein the frame defines an opening in the back thereof for receiving a toilet bowl therethrough.

5. The lift seat of claim 1, wherein the armrest means comprises a pair of armrests on opposite sides of the seating surface, at lest one of the armrests being fixed to the front link for movement therewith and wherein the spring means comprises a first spring connected at one end to the frame and at the other end to the armrest, whereby when the armrest is moved from a first position corresponding to the seat being raised to a second position corresponding to the seat being lowered, the first spring is stressed to store energy therein.

6. The lift seat of claim 5, wherein the first spring is a coil spring.

7. The lift seat of claim 5, wherein the spring means further includes a second spring connected between the four-bar linkage and the frame, wherein the second spring is oriented over center when the armrests are in the first position, and the four-bar linkage is expanded so as to maintain the four-bar linkage expanded wherein, when rotation of the armrest is initiated toward the second position, the second spring is pushed over center so as to resist collapse of the linkage in concert with the first spring.

8. The lift seat of claim 7, wherein the second spring is a gas spring which is in tension while over center to hold the four-bar linkage expanded and is in compression while in position to permit the four-bar linkage to collapse.

9. The lift seat of claim 8, wherein the gas spring goes over center when the four-bar linkage is collapsed and is oriented to urge the four-bar linkage to remain collapsed while the seat is lowered under the weight of a user.

10. The lift seat of claim 9, further including a damper extending between the frame and the four-bar linkage for resisting collapse of the four-bar linkage when the person sits on the seating surface and for resisting expansion of the four-bar linkage as the seating surface is moved from the lowered to the raised position so as to eliminate abrupt movements of the seating surface when a person is utilizing the lift seat.

11. A lift seat for moving a person from an initial raised position to a subsequent lowered position for sitting and thereafter back to the initial raised position to facilitate standing, the lift seat comprising:

a frame;

a seating surface upon which the person sits and applies a force due to the weight of the person;

a linkage for supporting the seating surface on the frame, the linkage being movable between a raised and lowered condition and comprising first link means pivoted at one end to the seat and at another end to the frame and second link means, spaced from the first link means, pivoted at one end to the seat and at another end to the frame, wherein the first link, second link, frame and seat form a four bar linkage which expands as the seat is raised and collapses as the seat is lowered;

armrest means for supporting the person using the seat movement of the armrest means initiating operation of the seat, the armrest means being secured to one of the links for movement therewith; and spring means coupled to the linkage and frame for resisting lowering of the seating surface from the raised to the lowered position and for storing energy provided by the weight of the person sitting on the seat for subsequently lifting the person from the lowered to the raised position.

12. The lift seat of claim 11, wherein the seat is connected to the frame only through the linkage.

13. The lift seat of claim 11, wherein the first and second links are pivoted directly to the seating surface and frame.

14. The first seat of claim 13, wherein the armrest means is fixed only to the links.

15. The lift seat of claim 11, wherein the armrest means is fixed only to the links.

16. The lift seat of claim 11, wherein the first link means is comprised of a pair of spaced front links, and the second link means is comprised of a pair of spaced rear links, the pairs of links being connected to one another to operate in unison.

17. The lift seat of claim 16, further including damper means coupled to the linkage for resisting movement of the linkage from a raised to a lowered position and from the lowered to the raised position.

18. The lift seat of claim 17, further including stop means disposed between the armrest means and the frame, the stop means engaging when the seat is in the raised position for preventing the linkage from moving from the raised to the lowered condition in a first direction and for allowing the linkage to move from the raised to the lowered condition in a second direction opposite the first direction.

19. The lift seat of claim 18, wherein the seating surface is a toilet seat and wherein the frame defines an opening in the back thereof for receiving a toilet bowl therethrough.

20. The lift seat of claim 17, wherein the armrest means comprises a pair of armrests on opposite sides of the seating surface, the armrests being fixed to the front links and being pivoted therewith and wherein the spring means comprises a first spring connected at one end to the frame and at the other end to the armrest, whereby when the armrest moves from a first position corresponding to the seat being raised to a second position corresponding to the seat being lowered, the first spring is tensioned.

21. The lift seat of claim 20, wherein the first spring is a coil spring.

22. The lift seat of claim 20, wherein the spring means further includes a second spring connected between the linkage and the frame, wherein the second spring is oriented over center when the armrests are in the first position, and the linkage is expanded so as to maintain the linkage expanded wherein, when rotation of the armrest is initiated toward the second position, the second spring is pushed over center so as to resist collapse of the linkage in concert with the first spring.

23. The lift seat of claim 22, wherein the second spring is a gas spring which is in tension while over center to hold the linkage raised and is in compression while in position to permit the linkage to lower.

24. The lift seat of claim 23, wherein the gas spring again goes over center when the linkage is lowered and is oriented to urge the linkage to remain lowered while the seat is lowered under the weight of a user.

25. The lift seat of claim 24, further including a damper extending between the frame and the linkage for resisting lowering of the linkage when the person sits on the seating surface and for resisting raising of the linkage as the seating surface is moved from the lowered to the raised position so as to eliminate abrupt movements of the seating surface when a person is utilizing the lift seat.

* * * * *